US005097897A

United States Patent [19]

Watanabe et al.

[11] Patent Number: 5,097,897

[45] Date of Patent: Mar. 24, 1992

[54] HEAT EXCHANGING DEVICE

[75] Inventors: Masataka Watanabe; Toshimi Hosokawa, both of Gunma, Japan

[73] Assignee: Sanyo Electric Co., Ltd., Osaka, Japan

[21] Appl. No.: 454,306

[22] Filed: Dec. 21, 1989

[30] Foreign Application Priority Data

Dec. 27, 1988 [JP] Japan ..... 63-332843

[51] Int. Cl.[5] ..... F28D 21/00

[52] U.S. Cl. ..... 165/140; 165/170; 165/171; 62/524

[58] Field of Search ..... 62/515, 524; 165/140, 165/156, 170, 171

[56] References Cited

U.S. PATENT DOCUMENTS 2,306,772 12/1942 Benson ..... 62/524
2,768,508 10/1956 Guyton ..... 165/170 X
3,058,722 10/1962 Rich ..... 165/156
3,252,292 5/1966 O'Connell et al. ..... 62/77
3,278,122 10/1966 Laing ..... 165/170 X
3,319,946 5/1967 Fulton, Jr. ..... 165/170 X

FOREIGN PATENT DOCUMENTS 1112574 5/1968 United Kingdom ..... 165/170

*Primary Examiner*—Martin P. Schwadron
*Assistant Examiner*—Allen J. Flanigan
*Attorney, Agent, or Firm*—Darby & Darby

[57] ABSTRACT

A heat exchanging device includes two heat exchangers, each of the heat exchangers including a metal plate and a pipe attached to the plate for conducting a heat exchanging medium, the plate with the pipe being bent into a winding, and the heat exchangers being arranged with respective axes of winding aligned with each other and with any opposite faces of the heat exchangers positioned with a specified distance not to come in contact with each other.

8 Claims, 8 Drawing Sheets

HEAT EXCHANGING DEVICE

BACKGROUND OF THE INVENTION i) Field of the Invention

The present invention relates to a heat exchanging device used for a freezer, an air-conditioner or the like and, more specifically, it relates to a heat exchanging device employing a heat exchanger which includes a single metal plate or two metal plates and a fluid channel positioned on the plate or between the plates for conducting a heat exchanging medium, the plate or plates with the fluid channel is bent into a winding like a coil.

ii) Description of the Prior Art

A heat exchanging device is disclosed in the U.S. Pat. No. 3,252,292 as a sheet-condenser 34, although not specifically explained. This type of condenser usually includes a single metal plate and a pipe bent into a serpentine curve and attached to the metal plate for conducting refrigerant. As shown in FIG. 2, the plate with the pipe is bent into a winding like a coil, so that the required space for installing the condenser is reduced.

For example, when the above-mentioned condenser is used in a refrigerator in which at least two condensing functions for a freezing device are required as in the case where two systems of compressor type refrigerant circuit are provided, the refrigerator 106 is provided with two condensers 100, 101 positioned in air channels 102, 103 formed independent of each other and provided with two independent air blowers 104, 105, as shown in FIG. 12.

With the above construction, a large space is required for forming the separate air channels or passage ways. As a result, the freezing device is large-sized, and two air blowers are required.

With the construction where a single air blower 104 is used as shown in FIG. 13, only a half of the flow rate of air is effectively used when one of the condensers is inactivated. This leads to inefficient operation.

With the construction where a single air blower 104 and a single air channel are provided and the condensers 100, 101 are connected in series with regard to the direction of flowing air, there arises a problem that the temperature of incoming air to the condenser 100 positioned on the leeward is higher than that of the condenser 101, so that the condensing capability is reduced.

SUMMARY OF THE INVENTION

A heat exchanging device according to the present invention has a plurality of heat exchangers, each of the heat exchangers including a single metal plate or two metal plates and a fluid channel or passage way on the plate, or between the plates, for conducting a heat exchanging medium. The plate, or plates, with the channel or passage way is bent into a winding like a coil, and the heat exchangers are assembled into a unit with respective axes of winding aligned with each other and with any opposite faces positioned with a specified distance so as not to come in contact with each other.

Thus, according to one aspect of the present invention, there is used not a single but a plurality of heat exchangers including a single metal plate, or two metal plates, and a fluid channel passage way on the plate, or between the plates, for conducting a heat exchanging medium, the plate or plates with the fluid channel being bent into a winding like a coil.

These heat exchangers are arranged with respective axes of winding aligned with each other so that their opposite faces are positioned by a specified distance and do not to come in contact with each other.

According to another aspect of the present invention, there is provided a heat exchanging device comprising a single heat exchanger, the heat exchanger including a single metal plate, or two metal plates, and two or more fluid channels or passage ways independently positioned on the plate or between the plates for conducting a heat exchanging medium. The channels are bent into a serpentine curve in parallel to each other, with the plate or plates with the channels being bent into a winding like a coil. The heat exchanger opposite faces positioned by a fixed distance not to come in contact with each other.

Thus, in the heat exchanging device according to the present invention, there is the single heat exchanger unit that has a configuration of a winding like a coil but there can be more than one heat exchanger, and more than two fluid channels or passage ways for conducting a heat exchanging medium that are independently formed. Those channels or passage ways are bent into a serpentine curve and positioned in parallel to each other, so that a small-sized heat exchanging device can be obtained.

DETAILED DESCRIPTION OF THE PREFERRED EMBODIMENTS

Figure 1:
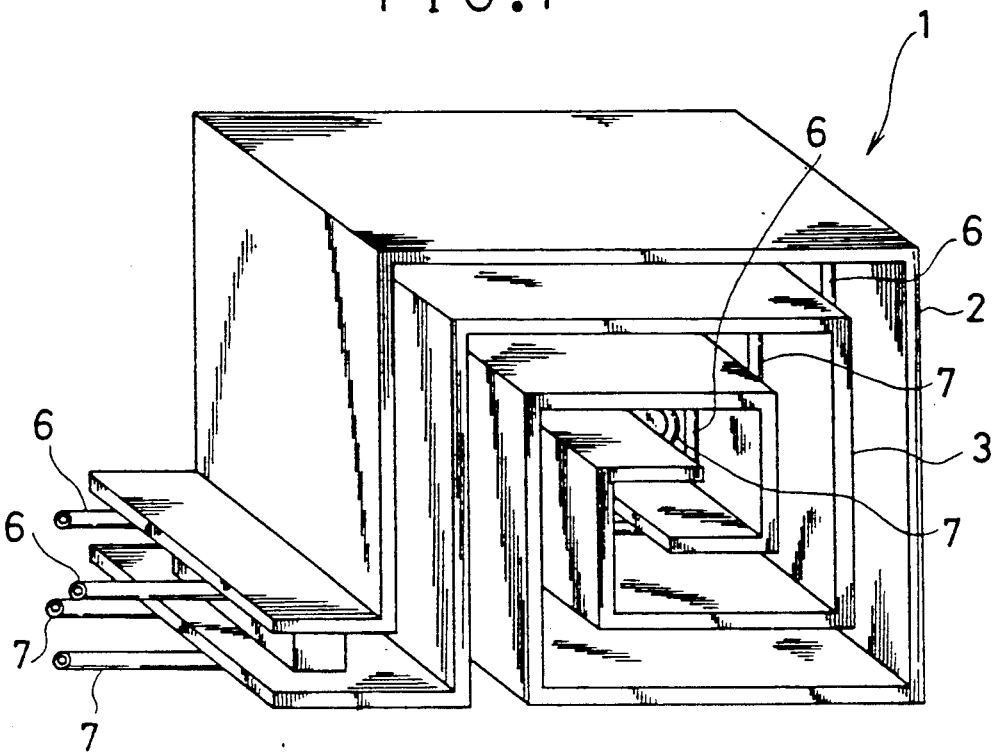
FIG. 1 is a perspective view showing an embodiment of a heat exchanging device according to the present invention.
Figure 2:
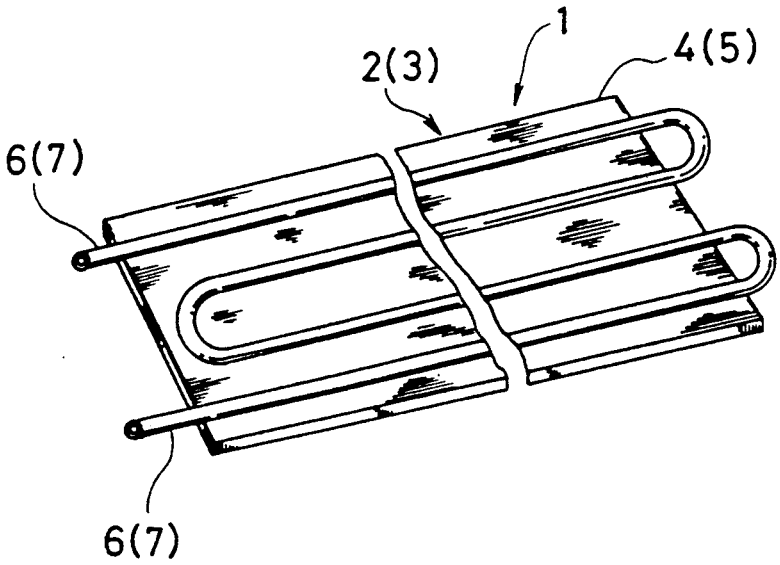
FIG. 2 is a perspective view showing a plate-shaped heat exchanger.

Embodiments according to the present invention will now be described with reference to the drawings. FIG. 1 is a perspective view of a condenser 1 of an embodiment of a heat exchanger. The condenser 1 includes two heat exchangers 2 and 3. As shown in FIG. 2, each of the heat exchangers 2 and 3 is comprised of a steel plate 4 (5) and a heat exchanging pipe 6 (7) formed independently to conduct a heat exchanging medium such as refrigerant. The heat exchanging pipe 6 (7) is bent into a serpentine curve having its straight portions extending along the direction corresponding to the longer sides of the plate 4 (5), and attached to the plate 4 (5). The plate 4 (5) with the pipe 6 (7) is bent into a winding like a coil.

Figure 3A:
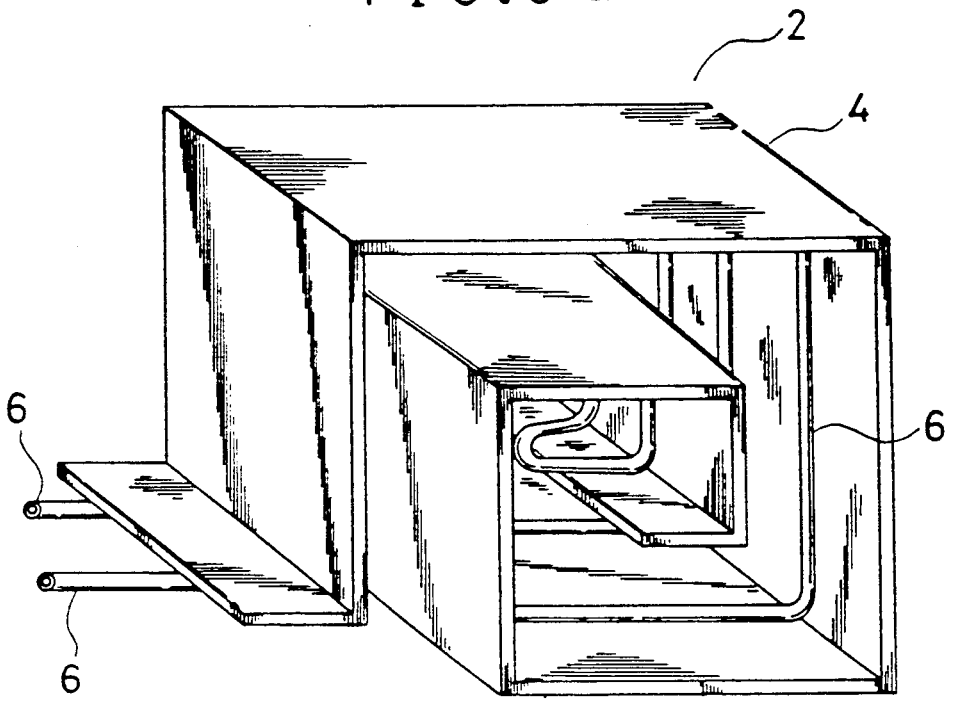
FIGS. 3*a* and 3*b* are perspective views showing individual heat exchangers.
Figure 3B:
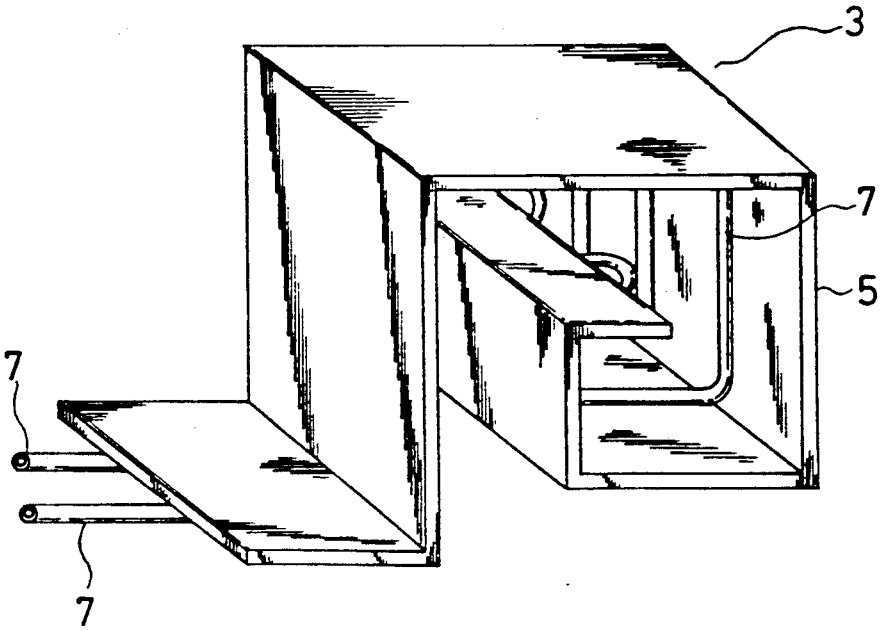

Thus the heat exchangers 2, 3 shown in FIGS. 3*a* and 3*b* are made.

Both of the heat exchangers 2, 3 are assembled into a unit with respective central axes of winding aligned with each other, as shown in FIG. 1. The heat exchangers 2, 3 have any bending lines deflected from each other so that any corresponding faces are positioned with a fixed specified distance so as not to come in contact with each other.

Figure 5:
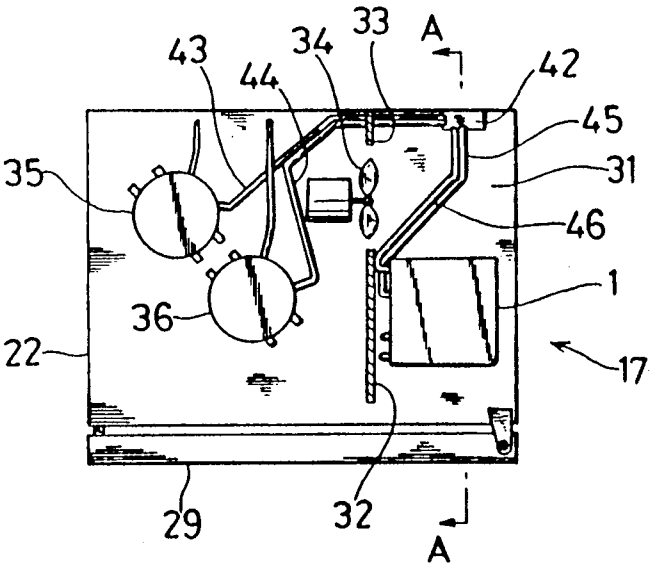
FIG. 5 is a plan view corresponding to FIG. 4.
Figure 4:
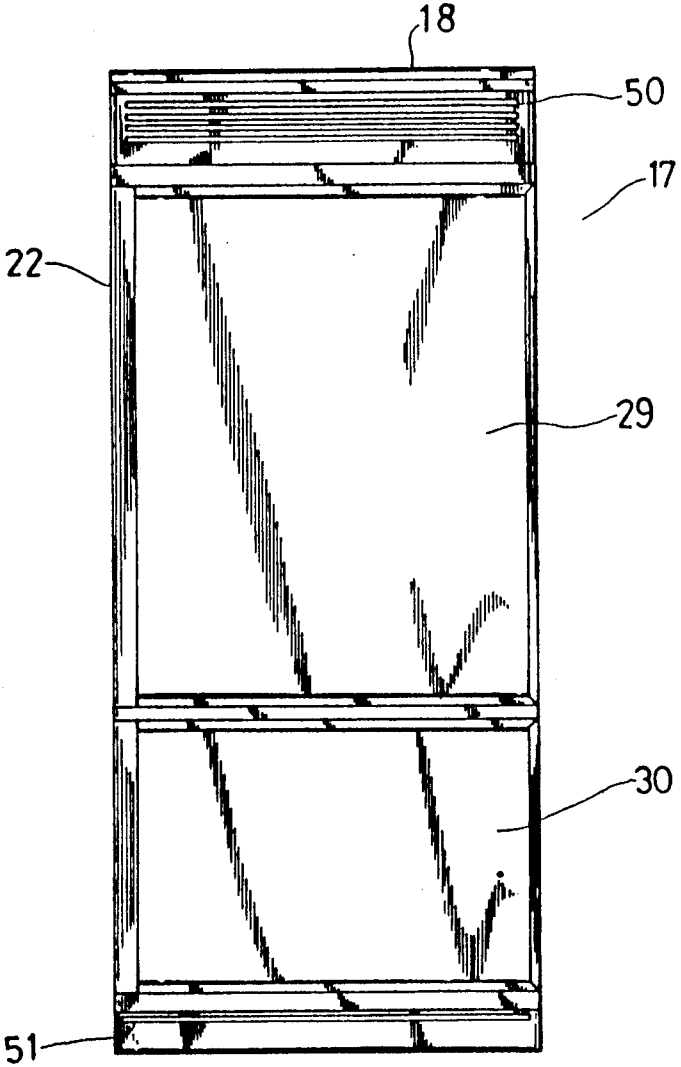
FIG. 4 is an elevational view showing a refrigerator in which is mounted the heat exchanging device shown in FIG. 1.
Figure 6:
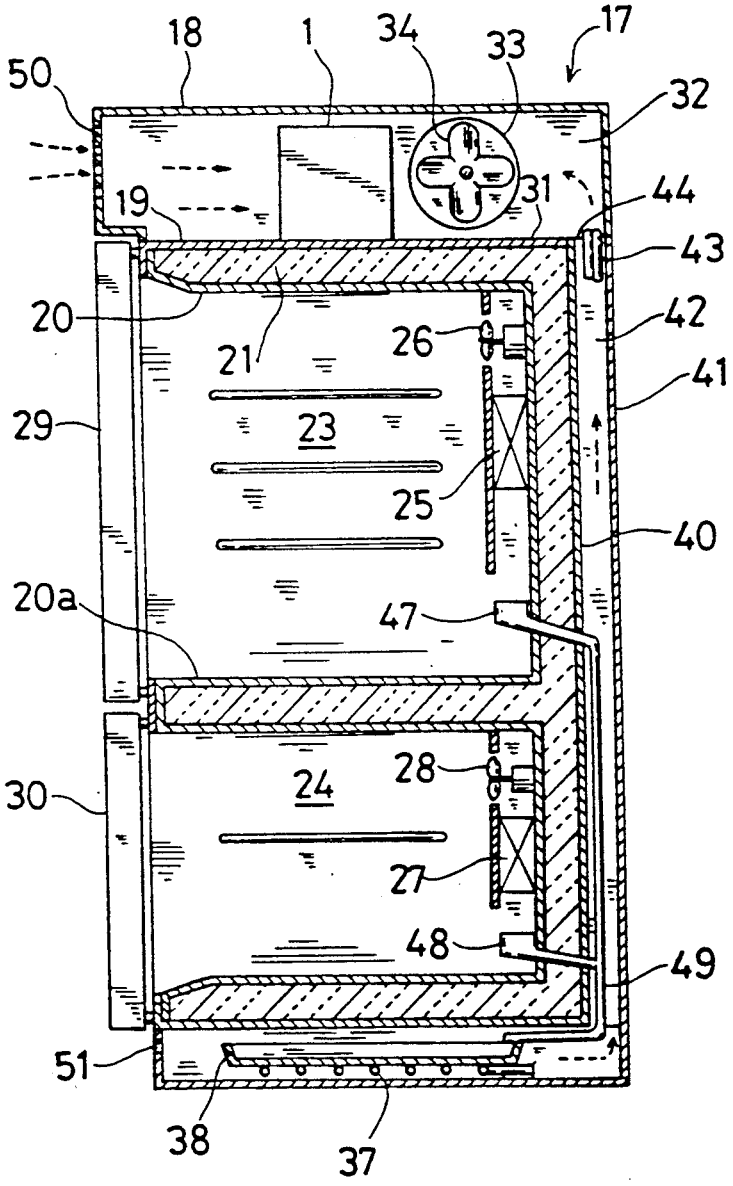
FIG. 6 is a sectional view taken along the line A—A of FIG. 5.

The condenser 1 is used as a condenser for a refrigerator 17. The refrigerator 17 is a so-called built-in type refrigerator as used in a system kitchen. FIG. 4 is an elevational view of the refrigerator 17, FIG. 5 is a plan view of the refrigerator 17 its cover 18 removed, and FIG. 6 is a sectional view taken along the line A—A in FIG. 5. The refrigerator 17 is provided with a heat insulating box 22 which is formed of an outer box 19 made of steel plate, an inner box 20 made of synthetic resin, and a heat insulating material 21 filled between the outer and inner boxes 19, 20 by a suitable forming technique. The inner box 20 is divided into an upper refrigerator compartment 23 and a lower freezer compartment 24 by a partition wall 20*a* which is a part of the inner box 20.

A cooler 25 is positioned at the back of the refrigerator compartment 23, and an air blower 26 is positioned above the cooler 25 for circulating cooling air. The air cooled by the cooler 25 circulates through the refrigerator compartment 23 to keep the refrigerator compartment 23 approximately at +5° C. A cooler 27 is also positioned at the back of the freezer compartment 24, and an air blower 28 is positioned above the cooler 27. The air cooled by the cooler 27 circulates through the freezer compartment 24 to keep the freezer compartment 24 at −20° C. Doors 29, 30 are provided for front openings of the refrigerator compartment 23 and the freezer compartment 24.

The condenser 1 is positioned on a ceiling plate 31 of the refrigerator 17. The ceiling plate 31 is covered with a unit cover 18 and partitioned into right and left parts by a partition plate 32. The condenser 1 is positioned on the right of the partition plate 32. The partition plate 32 is formed with an aperture 33 at the back of the condenser 1, and a suction type air blower 34 is positioned in this aperture 33. Two compressors 35, 36 are positioned in parallel at the back of the air blower 34. An evaporating condenser 37 having two systems of refrigerant pipe is positioned at the bottom of the heat insulating box 22, and an evaporating pan 38 is placed thereon.

A groove 40 is formed vertically extending on a part of a back plate 39 of the outer box 19. The groove 40 is shielded by a shield panel 41, thereby defining a duct 42 extending from the bottom of the heat insulating box 22 to its top, water from the coolers 25, 27 is received by drain pans 47, 48, conducted by a drain pipe 49 extending through the duct 42 and is held by the evaporating pan 38.

Figure 9:
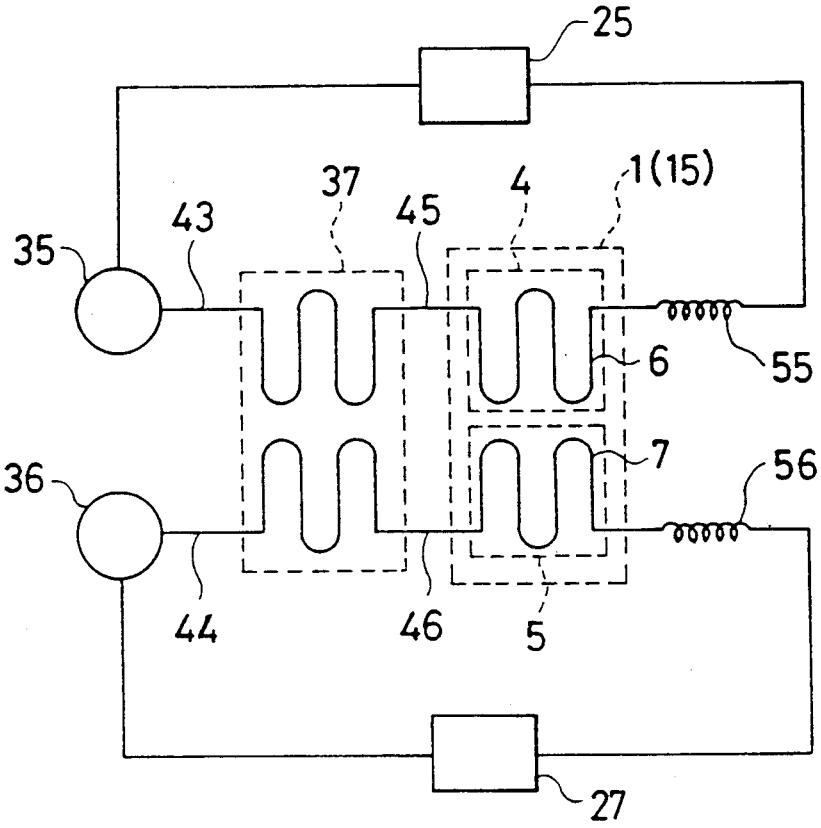
FIG. 9 is a diagram of a refrigerant circuit of the refrigerator.

Delivery pipes 43, 44 extend through the duct 42, and are connected to refrigerant pipes in different systems of the evaporating condenser 37. Pipes 45, 46 extends from the evaporating condenser 37 through the duct 42, and are connected to the pipes 6, 7 of the condenser 1, respectively. The pipe 6 extends from the condenser 1 and is connected to the cooler 25 while the pipe 7 is connected to the cooler 27. The pipes extending from the coolers 25, 27 are connected to an inlet of each of the compressors 35, 36, respectively. Thus, the refrigerator compartment 23 and the freezer compartment 24 are cooled by different systems of refrigerant circuit shown in FIG. 9, respectively. In FIG. 9, reference numerals 55, 56 denote capillary tubes.

The outermost wall of the winding in the condenser 1 serves as a casing to make an air channel for conducting air in the direction corresponding to the axis of the winding. The condenser 1 has a side without a wall directed to a space in front of the air blower 34. The unit cover 18 is formed with slits 50 in the front face. Air is sucked through the slits 50 by the operation of the air blower 34 as shown by arrows of a broken line. The air serves as an intake medium and passes between faces of the heat exchangers 2, 3 almost equivalently. As a result, the temperatures of air flowing in both the heat exchangers 2, 3 are almost the same, so that both the heat exchangers 2, 3 can attain almost equivalent, good heat exchange operation even when the compressors 35, 36 of the refrigerant circuits in the heat exchangers 2, 3 are working.

Figure 7:
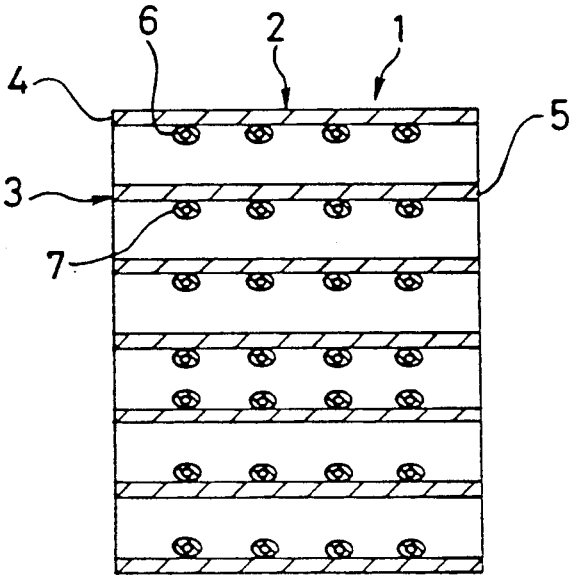
FIG. 7 is a sectional view showing a condenser.
Figure 8:
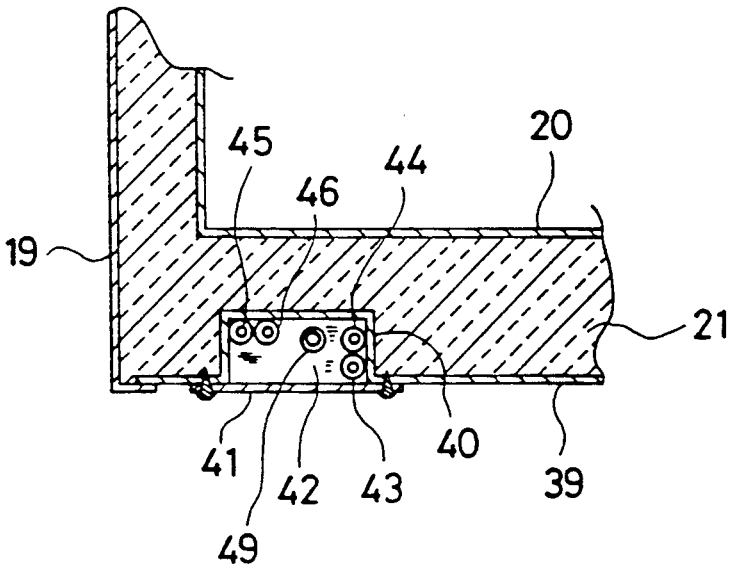
FIG. 8 is an enlarged sectional view showing a duct of the refrigerator.

Additionally, even when the compressor 35 or 36 of the refrigerant circuit in either one of the heat exchangers 2, 3 is working, air flows in contact with both of the heat exchangers, 2, 3 as shown in FIG. 7, whereby no air flows for non-useful purpose, and effective, heat exchange can be attained.

The heat exchangers 2, 3 may be integrated as a unit with screws or the like, with a spacer made of vibration absorbing material (e.g. rubber or foam polyethylene resin) retaining a specified distance therebetween at one end as shown in FIG. 1. Also, as described hereinafter, the bottom of each of the heat exchangers 2, 3 may be attached to the top plate 31 with screws, retaining a specified distance therebetween. The heat exchangers 2, 3 in the above mentioned first and second embodiments may also be attached to the top plate 31 with an L-shaped or cylindrical mounting bracket by screws.

As has been described, with the condenser 1 of the present invention, the required space for installation can be reduced, the heat exchange ratio in each of the heat exchangers can be improved and the capability of the heat exchangers can be unified.

Figure 10:
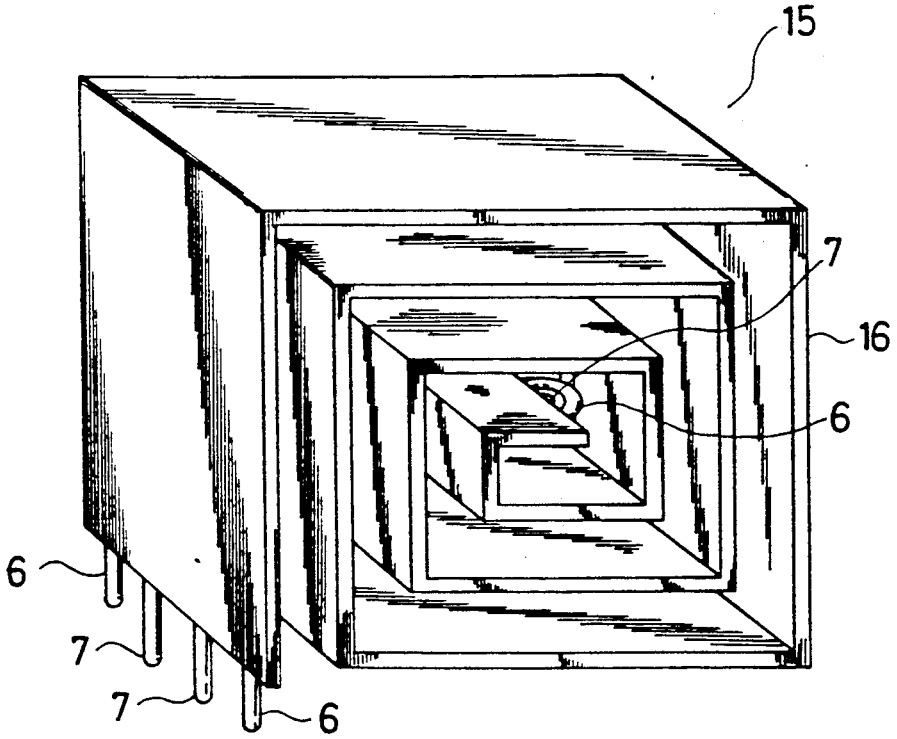
FIG. 10 is a perspective view showing another embodiment of the heat exchanging device.
Figure 11:
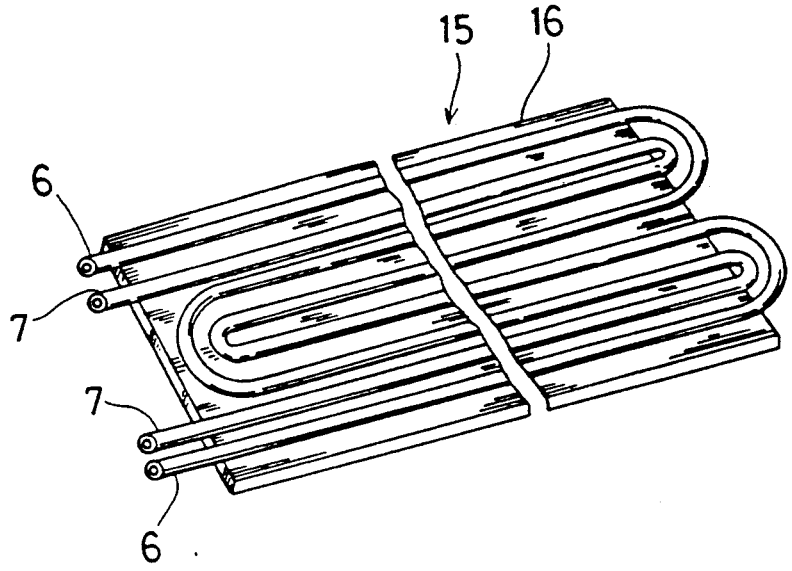
FIG. 11 is a perspective view of the plate-shaped heat exchanging device.
Figure 12:
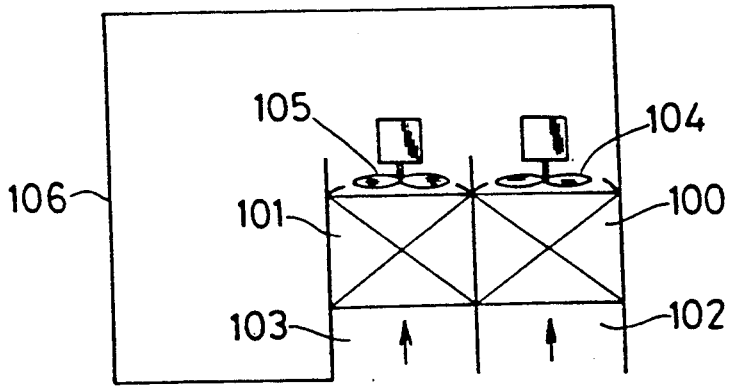
FIGS. 12 to 14 are diagrams showing a conventional condenser installed.
Figure 13:
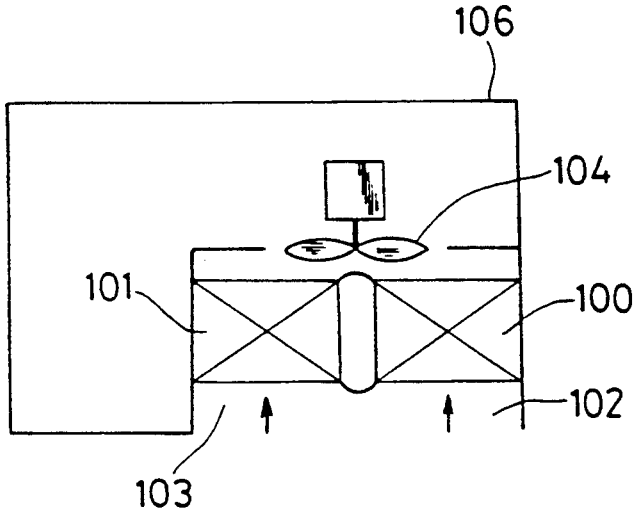
Figure 14:
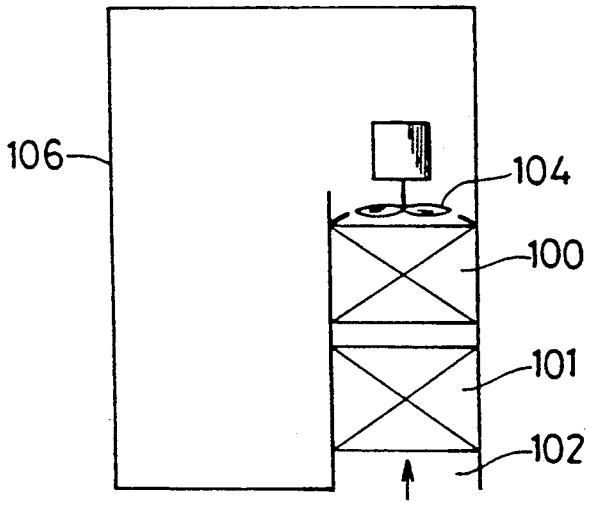

Still another embodiment of the present invention will now be described with reference to FIGS. 10 and 11. A condenser 15 of this embodiment includes a single steel plate 16 and the aforementioned pipes 6, 7 attached thereto as shown in FIG. 11. The pipes 6, 7 are bent into serpentine curves with respective straight portions extending along the direction corresponding to the longer sides of the steel plate 16, so that the pipes 6, 7 are arranged almost of equal length as related to the steel plate 16.

The condenser 15 is thus configured by bending the steel plate 16 into a winding like a coil together with the pipes 6, 7. Similar to the example shown in FIG. 7, the condenser 15 is positioned on the top plate 31 of the refrigerator 17, aligning the axis of the winding with the direction of flowing air. In addition to the aforementioned effect, this example allows the condenser 15 itself to further decrease in size.

The frost water contained by the evaporating pan 38 is evaporated with heat produced by the evaporating condenser 37 and discharged through the slits 51 formed in the front lower face of the refrigerator 17. However, the slits 15 must be unavoidably made small in due consideration of the external appearance. As a result, in a built-in type refrigerator as in the embodiments of the present invention, humid air around the evaporating pan 38 often causes the production of rust on parts of the pan. The humid air is sucked through the operation of the air blower 34 and discharged through the compressors 35, 36 from the slits 51. In this way, the formation of rust around the evaporating pan 38 and reduction of the evaporating capability are prevented.

In each of the embodiments, a so-called pipe-on-sheet system where a condenser is composed of s steel plate and a pipe attached thereto is employed, but any other system may be employed; a so-called roll-bond system where two steel plates are bonded to each other and a part of the mated steels is swelled to make a channel therebetween may be employed.

The duct 42 may also be used for wiring with electric cord and the like.

What is claimed is:

1. A heat exchanging device comprising a plurality of heat exchangers, each of said heat exchangers including a single metal plate or two metal plates and a fluid passage way on the plate or between the plates for conducting a heat exchanging medium, each said plate or plates with said fluid passage way being bent about a central axis into a spiral coil, said fluid passage way having an inlet and an outlet at one peripheral end of the plate, and said heat exchangers being assembled into a unit with respective axis of spiral aligned with each other and with the turns of said spiral coil being equally spaced from adjacent turns.

2. A device according to claim 1, wherein the spiral coil of each of said heat exchangers is formed by a plurality of bends each being substantially at a right angle.

3. A device according to claim 1, wherein there are two said heat exchangers.

4. A device according to claim 1, wherein each of said heat exchangers includes a single metal plate and a continuous fluid passage way heat-conductively attached to a major surface of said plate with the two ends of the fluid passage way at a peripheral end of the plate to from the inlet and outlet.

5. A device according to claim 4, wherein each of said heat exchangers has said metal plate bent together with said fluid passage way the spiral toward the side to which the passage way is located.

6. A device according to claim 1 wherein there are two independent fluid passage ways on a single plate, each said passage way having an inlet and an outlet at one peripheral end of the plate.

7. A device according to claim 1 wherein there are two plates each having an independent fluid passage way, the spiral coils of the two plates interfitting to form a single spiral of the two interfitting plates, the inlet and outlet of the fluid passage way of each plate located at the outer end of the single spiral.

8. A heat exchanging device comprising a single heat exchanger, said heat exchanger including a single metal plate or two metal plates and two or more discrete fluid channels independently positioned on the plate or between the plates for conducting a heat exchanging medium, each of said discrete fluid channels having an inlet and an outlet said channels being formed into a serpentine curve having sections parallel to each other, said plate or plates with said channels being bent into a spiral coil with the turns of said spiral coil being equally spaced from adjacent turns.

* * * * *